US006328428B1

(12) United States Patent
Keefe et al.

(10) Patent No.: US 6,328,428 B1
(45) Date of Patent: Dec. 11, 2001

(54) INK-JET PRINTHEAD AND METHOD OF PRODUCING SAME

(75) Inventors: Brian J. Keefe, La Jolla; Ali Emamjomeh, San Diego, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/296,940

(22) Filed: Apr. 22, 1999

(51) Int. Cl.[7] ..... B41J 2/05
(52) U.S. Cl. ..... 347/63; 347/67
(58) Field of Search ..... 347/20.44, 63.64

(56) References Cited

U.S. PATENT DOCUMENTS

| | | | |
|---|---|---|---|
| 4,663,640 | 5/1987 | Ikeda . | |
| 4,719,477 | 1/1988 | Hess . | |
| 5,073,785 | 12/1991 | Jansen et al. . | |
| 5,278,584 | 1/1994 | Keefe et al. . | |
| 5,317,346 | 5/1994 | Garcia . | |
| 5,469,199 | 11/1995 | Allen et al. | 347/42 |
| 5,485,185 | 1/1996 | Sueoka et al. | 347/64 |
| 5,635,968 | 6/1997 | Bhaskar et al. | 347/59 |
| 5,648,809 | 7/1997 | Steinfield et al. | 347/87 |
| 5,666,143 | 9/1997 | Burke et al. | 347/65 |

OTHER PUBLICATIONS

Hewlett–Packard Journal, Feb., 1994 pp. 41–45
Hewlett–Packard Journal, May, 1985 pp. 21–27 US Patent Application SN. 08/811,404, filed Mar. 4, 1997 Docket No. 10961330–1.
US Patent Application SN. 08/938,346, filed Sep. 26, 1997 Docket No. 10970458–1.

*Primary Examiner*—John Barlow
*Assistant Examiner*—Michael S Brooke

(57) ABSTRACT

A technique for improving lamination quality and for controlling NCA in an ink-jet printhead. With respect to lamination quality, printhead regions are identified where it is desirable to improve planarity or to reduce the likelihood of corner lift or barrier/orifice plate delamination. Planarization is accomplished by the insertion of a suitably configured composition of gold, metal-2 or metal-3 into an identified region in the thin film substrate, thereby eliminating substantially delamination between ink barrier layer and substrate. Substantial NCA control is achieved when a similarly configured composition is inserted into the thin film substrate to achieve planarization in the printhead region near the ink drop generators.

11 Claims, 4 Drawing Sheets

INK-JET PRINTHEAD AND METHOD OF PRODUCING SAME

BACKGROUND OF THE INVENTION

The present invention relates generally to a printhead for ink-jet printers and, more particularly, to techniques for improving flatness and lamination quality in an ink-jet printhead.

The art of ink-jet printing is relatively well developed. Commercial products such as computer printers, graphics plotters, and facsimile machines have been implemented with ink-jet technology for producing printed media.

Generally an ink-jet image is formed when a precise pattern of dots is ejected from a printhead onto a printing medium. Typically, an ink-jet printhead is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink-jet printhead includes an array of precisely formed nozzles in an orifice plate that is attached to a thin film substrate that implements ink firing heater resistors and apparatus for enabling the resistors. The thin film substrate is generally comprised of several thin layers of insulating, conducting or semiconductor material that are deposited successively on a supporting substrate in precise patterns to form, collectively, all or part of an integrated circuit. Deposition can be performed by mechanical, chemical or by vacuum evaporation methods.

In the printhead, an ink barrier layer defines ink channels including ink chambers disposed over associated ink firing resistors, and the nozzles in the orifice plate are aligned with associated ink chambers. Ink drop generator regions are formed by the ink chambers and portions of the thin film substrate and of the orifice plate that are adjacent the ink chambers.

The thin film substrate or die is typically comprised of a layer such as silicon on which are formed various thin film layers that form thin film ink firing resistors, apparatus for enabling the resistors, and interconnections to bonding pads that are provided for external electrical connections to the printhead. The thin film substrate more particularly includes a top thin film layer of tantalum disposed over the resistors as a thermomechanical passivation layer.

An example of the physical arrangement of the orifice plate, ink barrier layer, and thin film substrate is illustrated at page 44 of the *Hewlett-Packard Journal* of February, 1994. Further examples of ink-jet printheads are set forth in commonly assigned U.S. Pat. Nos. 4,719,577; 5,278,584 and 5,517,346, each of which is incorporated herein by reference.

Generally, circuit functionality determines thin film artwork. In this regard, differences in substrate thickness in functional, and in some cases nonfunctional, printhead regions, can result in structural failures of the printhead. For example, it is known that thin film topography can have a significant impact on the micro level. For example, in a typical stack, a tantalum layer is 6000 Angstrom units thick while a gold layer is 11000 Angstrom units thick and a metal-2 stack of tantalum/aluminum and aluminum has a thickness of 6000 Angstrom units. In some cases, thickness differences can be more pronounced where, for example, a metal-3 stack is modified. As used herein, the term "metal-2" refers to a composite comprising a thin film stack of tantalum-aluminum and aluminum. "Metal-3" refers to a composite of gold/tantalum.

Problems sometimes occur in conventional ink-jet printheads with respect to: a) barrier to orifice lamination and b) control of nozzle camber angle (NCA). With respect to lamination quality, for example, IJ5000 is a specially developed photoimageable dry film polymer that is used to define ink channels on the printhead. During the assembly process, this dry film is laminated onto the wafer where thin film topography is transmitted through the lamination thickness. In a subsequent assembly step, the polyimide orifice layer, flexible material sometimes 50 microns thick, is laminated to a singulated die.

This final lamination process, known as "staking", can result in printhead defects that are related to the thin film topography. These defects may be found in several printhead regions and, for example, may be evidenced by lack of corner lamination ("corner lift") or by the presence of bubbles between KaptonTm and barrier along the Ta/Au power trace boundary ("string bubbles").

With respect to the second condition, NCA is the relative angle between the orifice member in the nozzle region and center region (where the topography is assumed to be flat). Desirably, the printhead is coplanar with respect to the media being imprinted since any deviation from assumed coplanarity would produce dot placement error. Under ideal conditions, NCA is at or near 0 degrees. However, topographical considerations can affect NCA, generally tending to increase it. Thus, with respect to conventional ink-jet printheads, a need exists for controlling NCA, generally to reduce it. It is recognized however that under certain circumstances, there may be a need to increase NCA.

In view of the foregoing, a need exists for a technique for improving ink-jet printhead lamination quality to reduce substantially a likelihood of delamination between barrier and substrate. Desirably, the technique would include means of controlling NCA, to reduce it in the majority of cases but having a capability for increasing NCA if necessary.

DISCLOSURE OF THE INVENTION

In accordance with the present invention, a technique is provided for improving lamination quality and for controlling NCA in an ink-jet printhead. With respect to lamination quality, printhead regions are identified where it is desirable to improve planarity or to reduce the likelihood of corner lift or barrier/orifice plate delamination. Planarization is accomplished by the insertion of a suitably configured composition of tantalum, metal-2 or metal-3 into the thin film substrate in the identified region to planarize the substrate thereby eliminating substantially delamination between the ink barrier layer and the substrate. Substantial NCA control is achieved when a similarly configured composition is inserted into the thin film substrate to achieve planarization in the printhead region near the ink drop generators.

It will be recognized by one skilled in the art that while specific compositions are set forth herein and their use in specific printhead regions is disclosed, the invention is not limited to utilization of any specific composition nor to any specific printhead region. Thus, the present invention encompasses the use of conductive or insulating compositions not specifically mentioned herein.

The present invention affords several advantages. For example, it provides an effective and efficient technique for improving lamination quality, thereby preventing delamination in the printhead. Thus, the likelihood of problems such as corner lift is substantially reduced. Where it is desirable to achieve planarization near the center of the die, the insertion of a suitable composition, such as gold, under the barrier in that region adds support to the orifice plate to achieve planarization. NCA control is accomplished by the introduction of a composition, such as metal-2, under the barrier peninsula, in the region around the ink drop generators.

While specific examples of solutions to printhead problems in specific printhead regions are presented herein, it will be recognized that the planarization functionality described can be achieved in other regions of the printhead while utilizing a variety of compositions.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
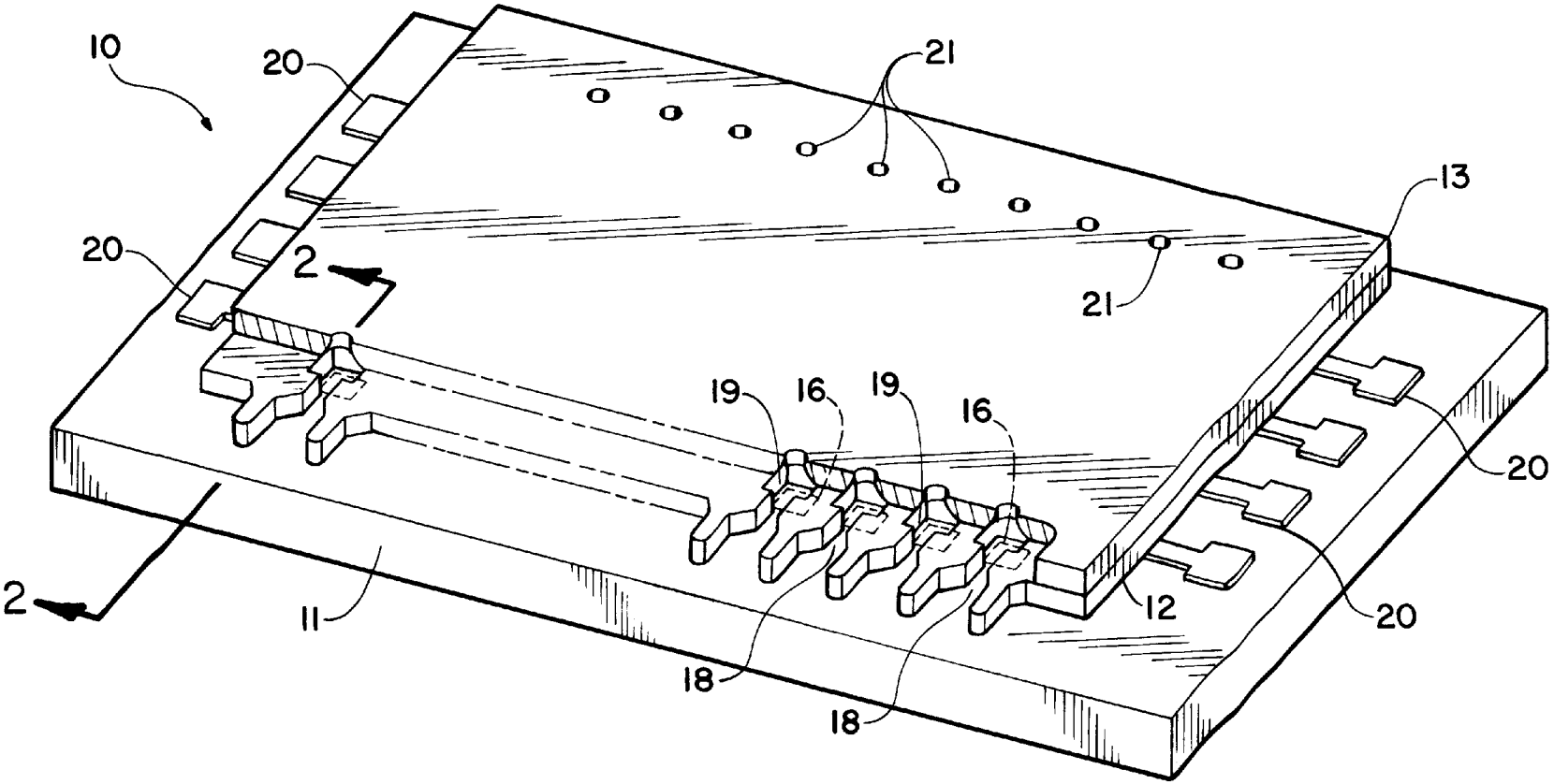
FIG. 1 is an unscaled schematic perspective view of a conventional ink-jet printhead showing a portion thereof cut away.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

In the following detailed description and in the several figures of the drawings, like elements are identified with like reference numerals. At the outset, in order to put the present invention into perspective, a prior art ink-jet printhead, with some of its limitations, will be described.

Referring to the drawings, and in particular to FIG. 1, there is shown an unscaled schematic perspective view of a conventional ink-jet printhead 10. The printhead 10 generally includes (a) a thin film substate or die 11 including a plurality of thin film layers, (b) an ink barrier layer 12, disposed on the substrate 11, and (c) an orifice or nozzle plate 13 bonded to the top of the ink barrier layer 12.

The thin film substrate 11 is formed according to conventional integrated circuit techniques and includes a plurality of stacked thin film layers. It will be recognized that the stacking process is functionally driven so that varying levels of substructure thickness may be found from one part of the substructure to another. This variation in thickness can produce topographical problems in the regions of the printhead under the drop generators or in the corner regions of the substrate 11, as discussed below.

By way of example, the ink barrier 12 is formed of a dry film that is pressure laminated to the thin film substrate 11 or a wet dispensed liquid cast film that is subsequently spun to uniform thickness and dried by driving off excess solvent. The barrier layer 12 is photo defined to form therein ink chambers 19 and ink channels 18 which are disposed over resistor regions which are on either side of a generally centrally located gold layer (FIG. 2) on the thin film substrate 11. Gold bonding pads 20 engagable for external electrical connections are disposed at the ends of the thin film substrate 11 and are not covered by the ink barrier layer 12. By way of illustrative example, the barrier layer material comprises an acrylate photopolymer dry film such as the Parad™ brand photopolymer obtainable from E.I. duPont de Nemours and Company of Wilmington, Del. Similar dry films include other duPont products, such as Riston™ brand dry film, and dry films made by other chemical providers.

The orifice plate 13 comprises, for example, a planar substrate comprised of a polymer material in which the orifices are formed by laser ablation as disclosed, for example, in commonly assigned U.S. Pat. No. 5,469,199, incorporated herein by reference. The plate 13 includes orifices 21 disposed over respective ink chambers 19, such that an ink firing resistor 16, an associated ink chamber 19, and an associated orifice 21 are aligned. An ink drop generator is formed by each ink chamber 19 and portions of the thin film substrate 11 and the orifice plate 13 that are adjacent the ink chamber 19.

The ink chambers 19 in the barrier layer 12 are more particularly disposed over respective ink firing resistors 16, and each ink chamber 19 is defined by the edge or wall of a chamber opening formed in the barrier layer 12. The ink channels 18 are defined by further openings formed in the barrier layer 12, and are integrally joined to respective ink firing chambers 19. By way of illustrative example, FIG. 1 illustrates an outer edge fed configuration wherein the ink channels 19 open towards an outer edge formed by the outer perimeter of the thin film substrate 11. Ink is supplied to the ink channels 18 and the ink chambers 19 around the outer edges of the thin film substrate, as more particularly disclosed, for example, in commonly assigned U.S. Pat. No. 5,578,584, incorporated herein by reference.

Figure 4:
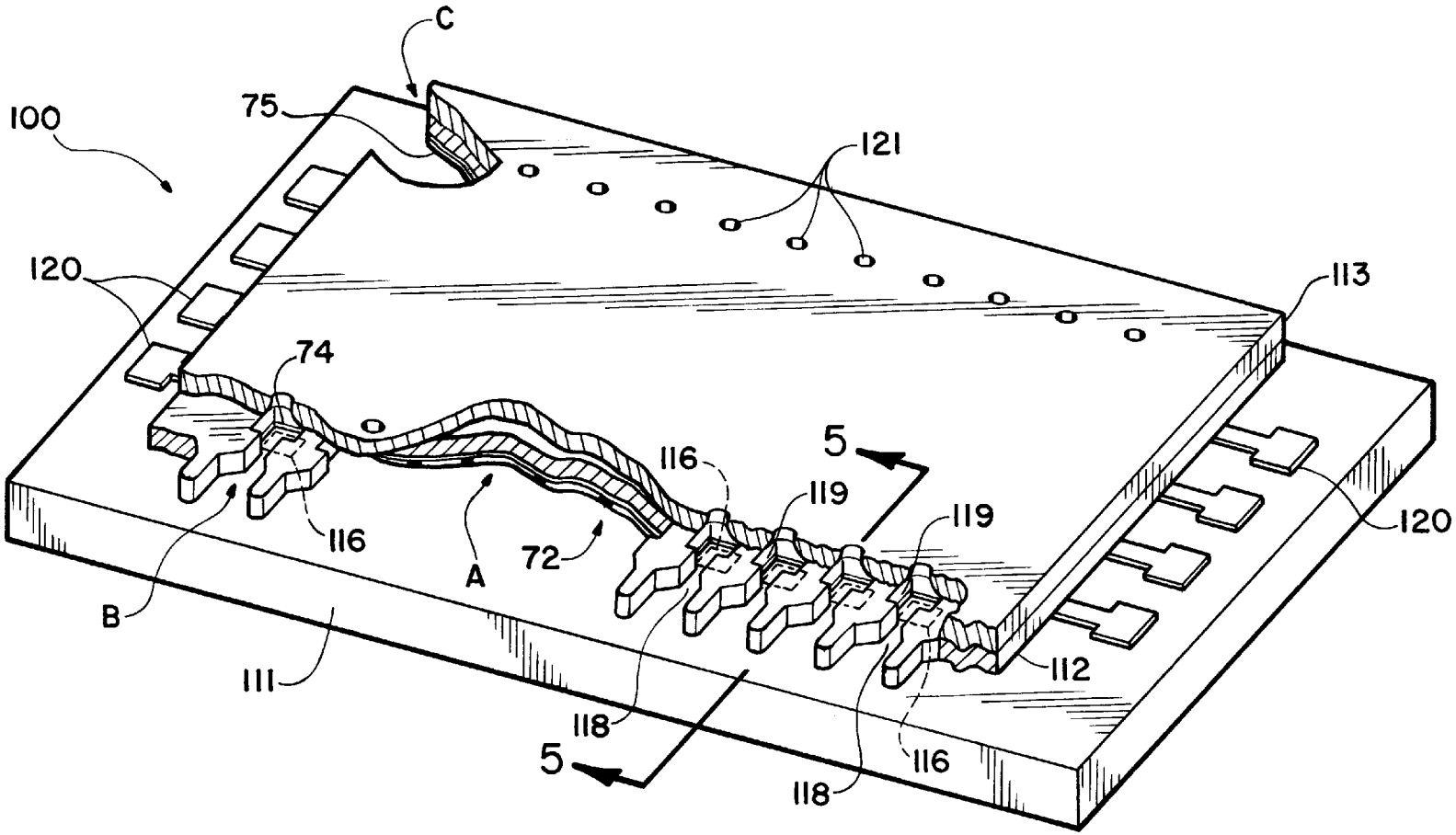
FIG. 4 is an unscaled schematic perspective view of an ink-jet printhead of the present invention showing portions thereof cut away.

Three regions of the printhead 10 are shown schematically in FIG. 4 wherein A generally designates a non-electrically functional region and B schematically shows the barrier peninsula in the region adjacent an ink drop generator. These regions play an important role in NCA control. A region generally designated by C schematically shows the region near the corner of the substrate or die 11 where delamination of the ink barrier 12 presents the above described problems.

Figure 2:
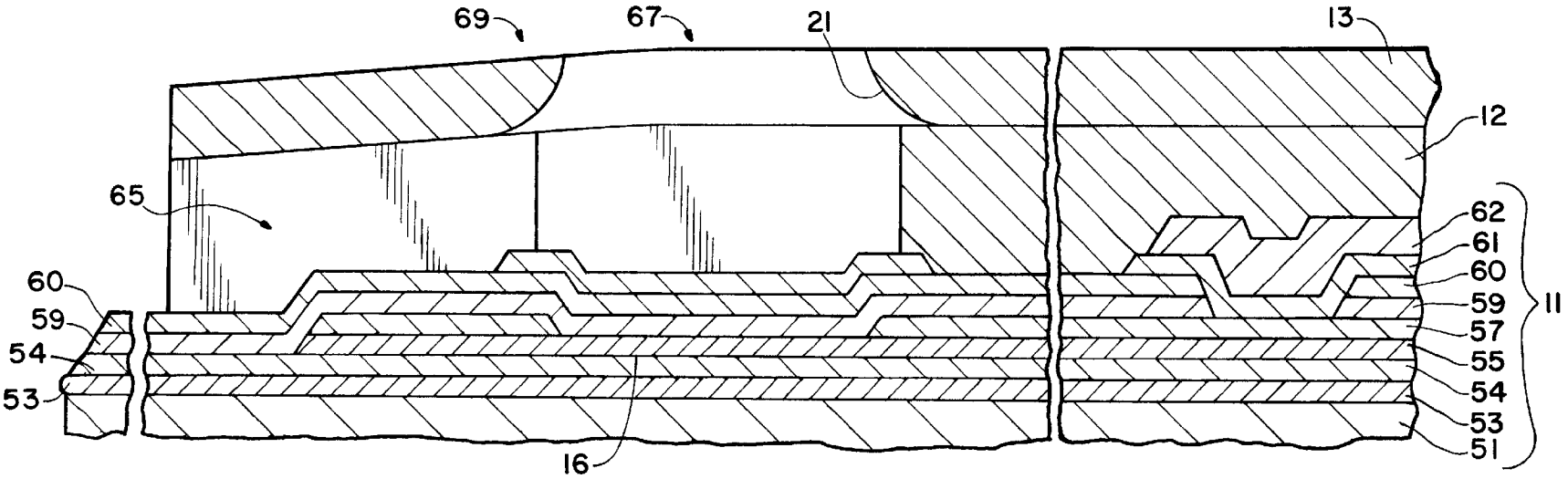
FIG. 2 is an unscaled schematic sectional view of the ink-jet printhead of FIG. 1, taken along the line 2—2 thereof showing a representative ink drop generator region of the printhead and deformation of the orifice plate.
Figure 3:
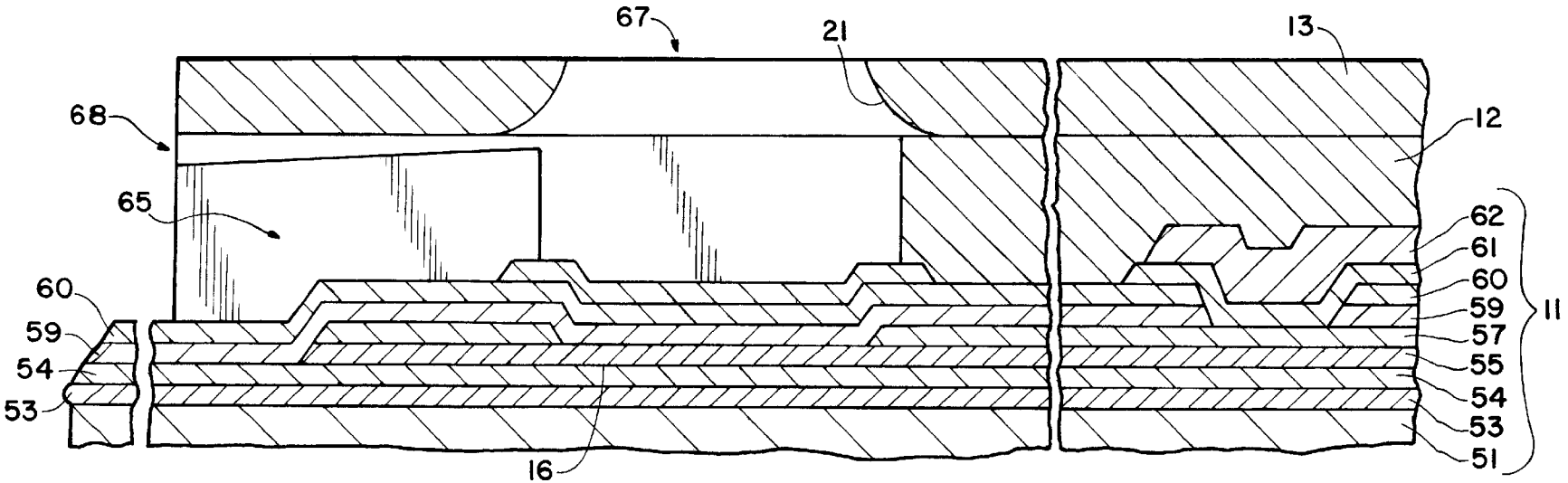
FIG. 3 is an unscaled schematic sectional view of the ink-jet printhead of FIG. 1, taken along the line 2—2 thereof showing a representative ink drop generator region and deformation of the ink barrier layer in the printhead.

While it is recognized that the conventional printhead discussed herein has substantial utility and value, certain limitations during manufacture can result in some defective printheads, as depicted in FIGS. 2 and 3. These figures are unscaled schematic cross sectional views of the printhead 10 of FIG. 1 taken laterally through a representative ink drop generator region and a portion of a centrally located gold layer region and illustrating specific embodiment of the thin film substrate 11 of prior art printheads.

The thin film substrate 11 more particularly includes a silicon substrate 51, a field oxide layer 53 deposited over the silicon substrate 51, and a patterned phosphorous doped oxide layer 54 disposed over the field oxide layer 53. A resistive layer 55 comprising tantalum-aluminum is formed on the phosphorous oxide layer 54, and extends over areas where thin film resistors, including ink firing resistors 16, are formed beneath the ink chambers 19. A patterned metallization layer 57 comprising aluminum doped with a small percentage of copper and/or silicon, for example, is disposed over the resistive layer 55.

The metallization layer 57 comprises metallization traces defined by appropriate masking and etching. The masking and etch of the metallization layer 57 also defines the resistive areas. In this regard, the resistive layer 55 and the metallization layer 57 are generally in registration with each other, except that portions of traces of the metallization layer 57 are removed in those areas where resistors are formed. A resistor area is defined by providing first and second metallic traces that terminate at different locations on the perimeter of the resistor area. The first and second traces comprise the terminal or leads of the resistor which effectively include a portion of the resistive layer between the terminations of the first and second traces. Pursuant to this resistor forming technique, the resistive layer 55 and the metallization layer 57 can be simultaneously etched to form patterned layers in registration with each other. Later, openings are etched in the metallization layer 57 to define resistors. The ink firing resistors are thus particularly formed in the resistive layer 55 pursuant to gaps in traces in the metallization layer 57.

A composite passivation layer 59, 60 comprising a layer of silicon nitride ($Si_3N_4$) and a layer of silicon carbide (SiC) is deposited over the metallization layer 57, the exposed portions of the resistive layer 55 and the exposed portions of the oxide layer 54. A tantalum passivation layer 61 is deposited on the composite passivation layer 59, 60 over the ink firing resistors 16. The tantalum passivation layer 61 can extend also to areas over which a patterned gold layer 62 is formed for external electrical connections, in a conventional manner, to the metallization layer 57.

In reference to FIGS. 2 and 3, showing problems in prior art printheads, it will be noted that the tantalum passivation layer 61 follows a well defined shoulder generally indicted by the reference character 65 which, as well as the tantalum layer 61, following underlying topography, is deflected away from the orifice plate 13. This factor can cause the problems depicted in FIGS. 2 and 3.

In the first case (FIG. 2), the barrier layer 11 becomes distorted as it conforms to the underlying substructure topography. Since the ink barrier layer 11 is bonded to the orifice plate 13, distortion in the barrier layer is, in turn, transmitted to the orifice plate 13 in a region generally indicated by 69. Distortion in this region alters the alignment of the ink emitting orifices 21 and their respective ink drop generator center regions generally indicated by 67. The result of this alteration of alignment is an unwanted change, generally an increase, in NCA.

FIG. 3 shows the second problem sometimes encountered in conventional printheads. Here, the orifice plate resists conforming to substrate topography while the ink barrier layer 11 conforms by separating from the plate 13 at a delamination region 68. Such delamination, of course, results in printhead failure, as discussed above.

Referring now to FIG. 4, there is shown an unscaled schematic view of an ink-jet printhead 100 of the present invention. The printhead 100 is similar in construction and function to the printhead 10 and it generally includes (a) a thin film substructure or die 111 comprising a substrate such as silicon and having various thin film layers formed thereon, (b) an ink barrier layer 112, disposed on the thin film substructure 111, and (c) an orifice or nozzle plate 113, including orifices 121, attached to the top of the ink barrier layer 112.

Similarly, ink chambers 119 in the barrier layer 112 are more particularly disposed over respective ink firing resistors 116, and each ink chamber 119 is defined by the edge or wall of a chamber opening formed in the barrier layer 112. The ink channels 118 are defined by further openings formed in the barrier layer 112, and are integrally joined to respective ink firing chambers 119. Bonding pads 120 are identical to their counterparts in the printhead 10.

Three regions of the printhead 100 are shown schematically in FIG. 4. The region generally designated by A is a non-electrically functional area in the center of the die, region B schematically shows the barrier peninsula adjacent an ink drop generator and a region generally designated by C is a corner region of the die 111. The topography of the regions A and B play an important role in NCA in conventional printheads. The region C, near the corner of the die is a location where delamination of the ink barrier 12 presents a problem ("corner lift") in conventional printheads.

The present invention is useful for preventing the above-described cases of failures of planizaration. By the insertion of a suitably structured composition of tantalum, metal-2 or metal-3 into the thin film substrate, the substructure topography is substantially smoothed out. As a result, prior art problems of lack of planarity and barrier layer delamination are substantially eliminated. In addition, the insertion of such compositions into the thin film substrate in the peninsular regions of the die 111 provides a substantial capability for control of NCA. It should be noted that while specific compositions are discussed as materials of choice, the use of other suitable materials is within the scope of this invention. In addition, while specific printhead regions are mentioned, the present invention has application to other printhead regions.

Figure 5:
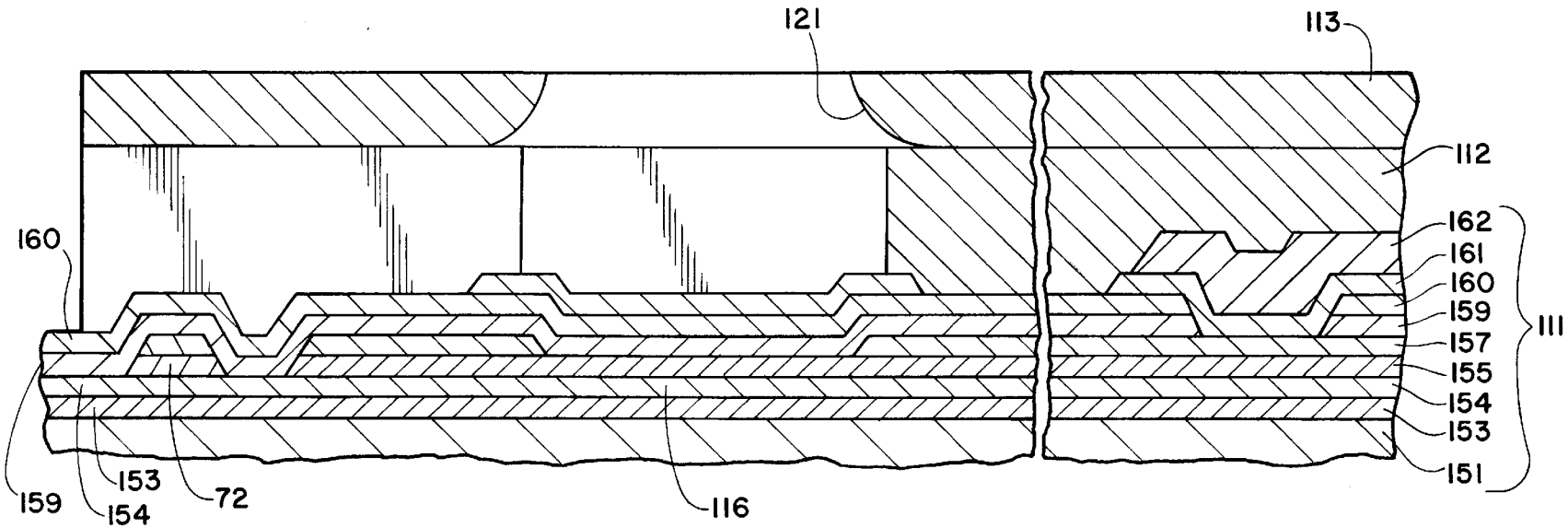
FIG. 5 is an unscaled schematic sectional view of the ink-jet printhead of FIG. 4, taken along the line 5—5 thereof, showing an embodiment of the present invention.

The structure of the printhead 100 is shown in FIG. 5. It is similar to that of the printhead 10 having a thin film substrate or die 111 including a silicon layer 151, a field oxide layer 153 deposited over the silicon layer 151, and a patterned phosphorous doped oxide layer 154 disposed over the field oxide layer 153. A resistive layer 155 comprising tantalum aluminum is formed on the phosphorous oxide layer 154. A patterned metallization layer 157, similar in structure and function to the layer 57 of the printhead 10, is disposed over the resistive layer 155. Ink firing resistors 116 are formed in a manner similar to that of the printhead 10.

A composite passivation layer 159, 160 comprising a layer of silicon nitride ($Si_3N_4$) and a layer of silicon carbide (SiC) is deposited over the metallization layer 157, the exposed portions of the resistive layer 155 and the exposed portions of the oxide layer 153. A tantalum passivation layer 161 is deposited on a composite passivation layer 159, 160 over the ink firing resistors 116. The tantalum passivation layer 161 can extend also to areas over which a patterned gold layer 162 is formed for external electrical connections, in a conventional manner, to the metallization layer 157.

In a preferred embodiment of the invention, as shown in FIG. 5, a metal-2 insert 72 is inserted under the SiN, SiC passivation layer 159, 160. In this manner, a degree of topography is attained which avoids the problems presented by the shoulder 65 of the printhead 10. As a result, problems of orifice plate deformation, as shown in the region 69 (FIG. 2) and delamination as shown in the region 68 (FIG. 3) are eliminated. In this manner, satisfactory levels of printhead lamination and planarization are achieved.

As set forth previously, the present invention can be used in a number of regions of the printhead 100. Thus, with reference to FIG. 4, metal-3 inserts 72 are shown in the non-electrically functional region A. In a similar manner, metal-2 designated by the reference numeral 75 has been added in the corner region C, under the barrier 111 to avoid topography effects on barrier lamination quality in this region. Finally, with regard to the region B, metal-2, generally designated by the reference numeral 74, has been added under the barrier to planarize and to control NCA at that location.

One skilled in the art will realize that while the invention has been described with respect to printheads utilizing the outer edge fed configuration, it can be employed also, in a center edge fed ink-jet printhead such as that disclosed in previously identified U.S. Pat. No. 5,317,346, incorporated herein by reference. In the latter configuration, the ink channels open towards an edge formed by a slot in the middle of the thin film substrate.

From the foregoing it will be appreciated that the invention provides an efficient and effective technique for improving planarization of ink-jet printheads while substantially eliminating the NCA problem. The technique is simple to implement and it affords application, as necessary, to several regions of the printhead.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. A method of controlling nozzle camber angle in an ink-jet printhead, comprising the steps of:

providing an orifice plate, said orifice plate including a plurality of ink emitting orifices;

providing a plurality of ink drop generators, each one of said ink drop generators having a center region generally aligned with a respective ink drop emitting orifice;

providing a thin film substrate disposed under said orifice plate and adjacent each one of said plurality of ink drop generators, said substrate including a plurality of thin film layers;

determining the relative angle between one of said ink emitting orifices and its respective ink drop generator center region to ascertain nozzle camber angle; and forming an insert in said thin film substrate for helping to align said ink emitting orifice with its respective ink drop generator center region thereby to control nozzle camber angle in said printhead.

2. The method according to claim 1, wherein said forming step includes selecting a material as an insert from the group consisting of gold/tantalum, tantalum and tantalum-aluminum/aluminum.

3. The method according to claim 2, wherein said forming step includes selecting an electrically conductive insert.

4. The method according to claim 2, wherein said forming step includes selecting an electrically insulating insert.

5. A method of planarizing an ink-jet printhead, comprising the steps of:

providing an orifice plate, said orifice plate including a plurality of ink emitting orifices;

providing a thin film substrate disposed under said orifice plate, said substrate including a patterned thin film layer, wherein said patterned thin film layer causes a lack of planarization in said thin film substrate;

identifying a thin film substrate region having a lack of planarization; and forming an insert in said thin film substrate region to enable planarization in said printhead.

6. The method according to claim 5, wherein said forming step includes selecting an insert from the group consisting of gold/tantalum, tantalum and tantalum-aluminum/aluminum.

7. A thin film ink-jet printhead comprising:

an orifice plate;

a thin film substrate including a first region having a plurality of thin film layers and a second region in which at least one of said plurality of thin film layers is a patterned thin film layer, wherein the presence of said patterned thin film layer causes a lack of planarization between said plurality of thin film layers and said orifice plate; and an insert, disposed between said orifice plate and said plurality of thin film layers for effecting planarization therebetween.

8. The thin film ink-jet printhead according to claim 7, wherein the insert is selected from the group consisting of gold/tantalum, tantalum and tantalum-aluminum/aluminum.

9. The thin film ink-jet printhead according to claim 7, wherein the insert is an electrically conductive composition.

10. The thin film ink-jet printhead according to claim 7, wherein said insert includes tantalum-aluminum/aluminum.

11. The thin film ink-jet printhead according to claim 7, wherein said printhead includes a corner region and said insert disposed under said corner region, said insert including tantalum-aluminum/aluminum.

* * * * *